United States Patent [19]

Hollingsworth et al.

[11] Patent Number: 4,839,944

[45] Date of Patent: Jun. 20, 1989

[54] FEED ROLL SENSOR FOR A TEXTILE CARDING MACHINE

[75] Inventors: John D. Hollingsworth, Greenville; Gary H. Rookstool, Simpsonville, both of S.C.

[73] Assignee: John D. Hollingsworth On Wheels, Inc., Greenville, S.C. ; a part interest

[21] Appl. No.: 107,666

[22] Filed: Oct. 13, 1987

[51] Int. Cl.[4] ..... D01G 23/06; D01H 5/38

[52] U.S. Cl. ..... 19/105; 19/240

[58] Field of Search ..... 19/105, 240

[56] References Cited

U.S. PATENT DOCUMENTS

| | | | |
|---|---|---|---|
| 4,163,927 | 8/1979 | Grice | 19/240 X |
| 4,275,483 | 6/1981 | Roberson | 19/240 |
| 4,438,548 | 3/1984 | Grunder | 19/240 X |
| 4,506,413 | 3/1985 | Leifeld | 19/240 X |
| 4,646,387 | 3/1987 | Oswald et al. | 19/240 X |

*Primary Examiner*—Louis K. Rimrodt
*Attorney, Agent, or Firm*—Cort Flint

[57] ABSTRACT

Apparatus for sensing the amount of fibers fed to a textile carding machine is disclosed which includes a feed roll (10) affixed to the frame of the carding machine for feeding fibers through a nip (26) between the feed roll and a feed plate (24). A rotational drive (B) is affixed at a free end of a feed roll shaft (40) in a free manner relative to the carding machine frame. Reaction force sensor (C) is mechanically coupled between rotational drive (B) and carding machine frame (12). Sensor means (C) senses the reaction forces on the rotational drive caused by the torque of feed roll (10) during feeding of fibrous mass (F) through nip (26). Sensor (C) includes a displaceable torque arm (50) and a sensor member (56). Sensor (56) senses the displacements of torque arm (50) which is affixed to rotational drive (B).

16 Claims, 3 Drawing Sheets

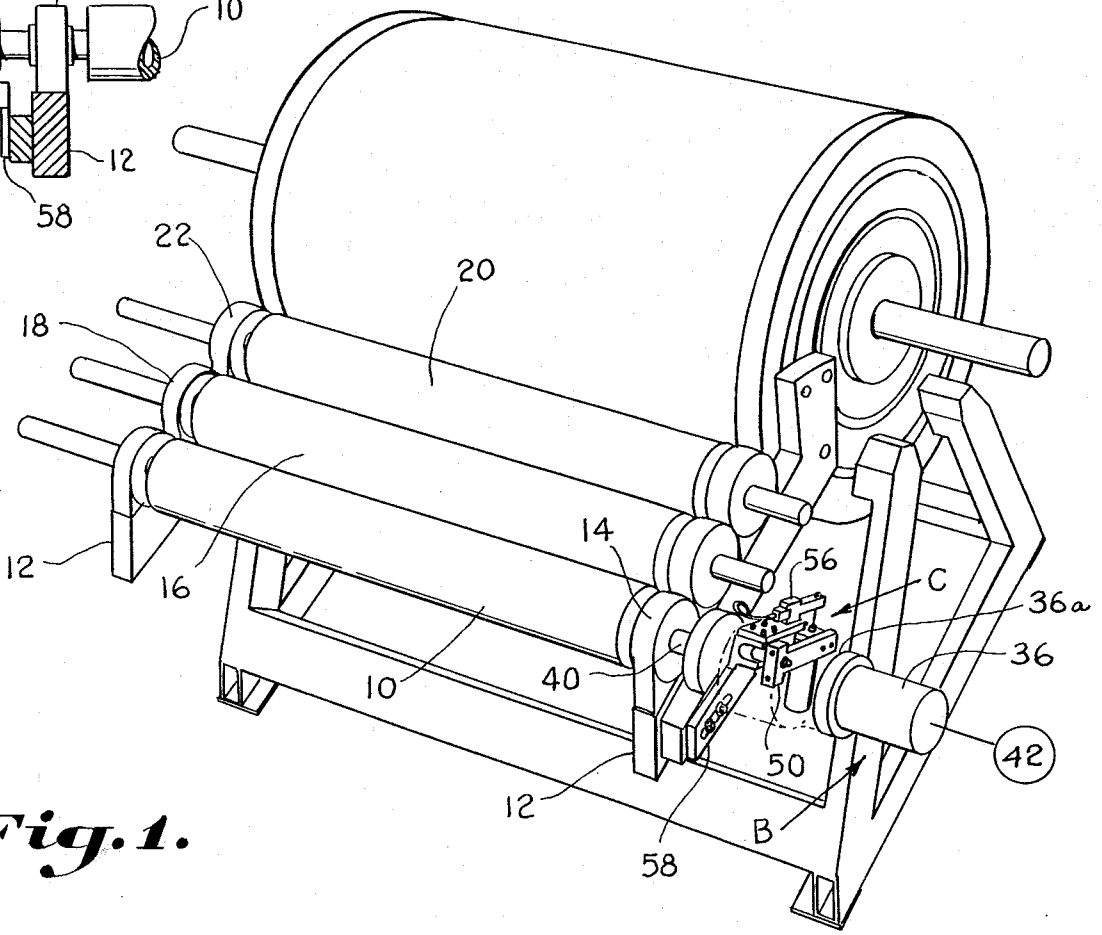
Fig. 1.
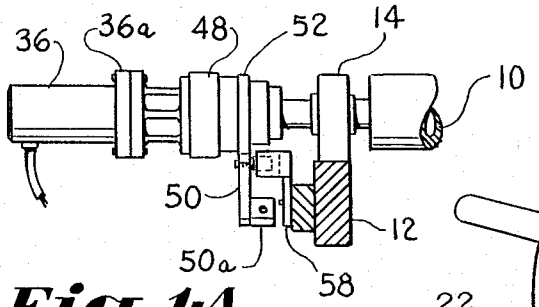
Fig. 1-A.

FEED ROLL SENSOR FOR A TEXTILE CARDING MACHINE

BACKGROUND OF THE INVENTION

The invention relates to the field of carding textile fibers on a textile machine and more particularly, to regulating the feed of fibers to a carding machine which produces a sliver or web output having a uniform weight per unit length. Typically, the carded web or sliver has a weight per unit length which is highly uniform. It is desirable to hold weight variations within 5 grams from a prescribed weight. The web weight delivered by the carding machine is usually determined by the relative speed of the card feed roll and the doffer cylinder, and the density of the fibrous mass entering the machine at the feed roll.

Many prior arrangements have been proposed to regulate the feeding of the fibrous mass by the card feed roll. A thorough discussion of these arrangements may be had by reference to U.S. Pat. No. 4,275,483. This patent proposes, among other things, to sense the thickness of the fibrous mass, between the nip of a movable feed roll and a fixed feed plate by sensing the linear displacement of the feed roll. However, this requires that the feed roll be mounted to the frame of the carding machine in such a manner that the bearings are displaceable. The result is a more complicated mechanical structure at the infeed of the carding machine. If displaceable, the feed roll must be weighted satisfactorily against the fibrous mass. U.S. Pat. No. 4,506,413 used a displaceable feed plate and fixed feed roll arrangement for sensing the amount of fibers fed by the card feed roll. While it is highly desirable to sense and correct the fiber feed at generally the same point, i.e. the feed roll, the arrangements using movable parts have been relatively more complicated and not altogether satisfactory.

It has also been proposed to sense torque on a feed roll by using a strain guage arrangement connected between a drive pulley and a feed roll shaft to sense feed roll torque. The drive pulley is driven by a chain by a remote drive motor. This also results in an arrangement of relative complexity and practicality.

Accordingly, an object of the invention is to provide a simple and reliable sensor for sensing and correcting the quantity of fibers fed to a carding machine at a card feed roll.

Another object of the invention is to provide a sensor for accurately sensing fibers fed by a card feed roll of a carding machine in a highly responsive manner so that the web produced on the machine may be accurately controlled.

Another object of the present invention is to provide a sensor for sensing a reaction force to the forces produced on a card feed roll as an indication of the amount of fibers fed by the card feed roll on a carding machine for use in producing a web or sliver having a uniform weight per unit length. Still another object of the present invention is to provide a simple and accurate sensor for sensing feed roll torque produced by feeding fibers to a carding machine and generating a control signal that may be used to regulate the speed of the feed roll and to obtain the feeding of a prescribed quantity of fiber.

SUMMARY OF THE INVENTION

The above objectives are accomplished according to the invention by providing a sensor which senses torque or a reaction to the torque of the feed roll. Preferably, this is done by measuring the reaction produced on a rotational drive which directly rotates the feed roll. The rotational drive may be mounted directly onto the shaft of the feed roll. The card feed roll is rotatably fixed to the frame by suitable bearings. The rotational drive is coupled to the frame by a torque sensor and means are provided for preventing breakage of the torque sensor should excessive torque be encountered. In this manner, a radial torque arm rigid with the rotational drive may be used as a torque sensing member to sense the reaction of the rotational drive unit to feed roll torque. Displacement of the torque arm may be sensed by a sensor member to generate a control signal representative of the thickness of the fibrous mass and quantity of fibers being fed to the carding machine.

DESCRIPTION OF THE DRAWINGS

The construction designed to carry out the invention will hereinafter be described, together with other features thereof.

The invention will be more readily understood from a reading of the following specification and by reference to the accompanying drawings forming a part thereof, wherein an example of the invention is shown and wherein:

FIG. 1 is a perspective view illustrating a feed roll sensing device constructed in accordance with the present invention;

FIG. 1A is a partial elevation of the feed roll sensing device;

DESCRIPTION OF A PREFERRED EMBODIMENT

Figure 2:
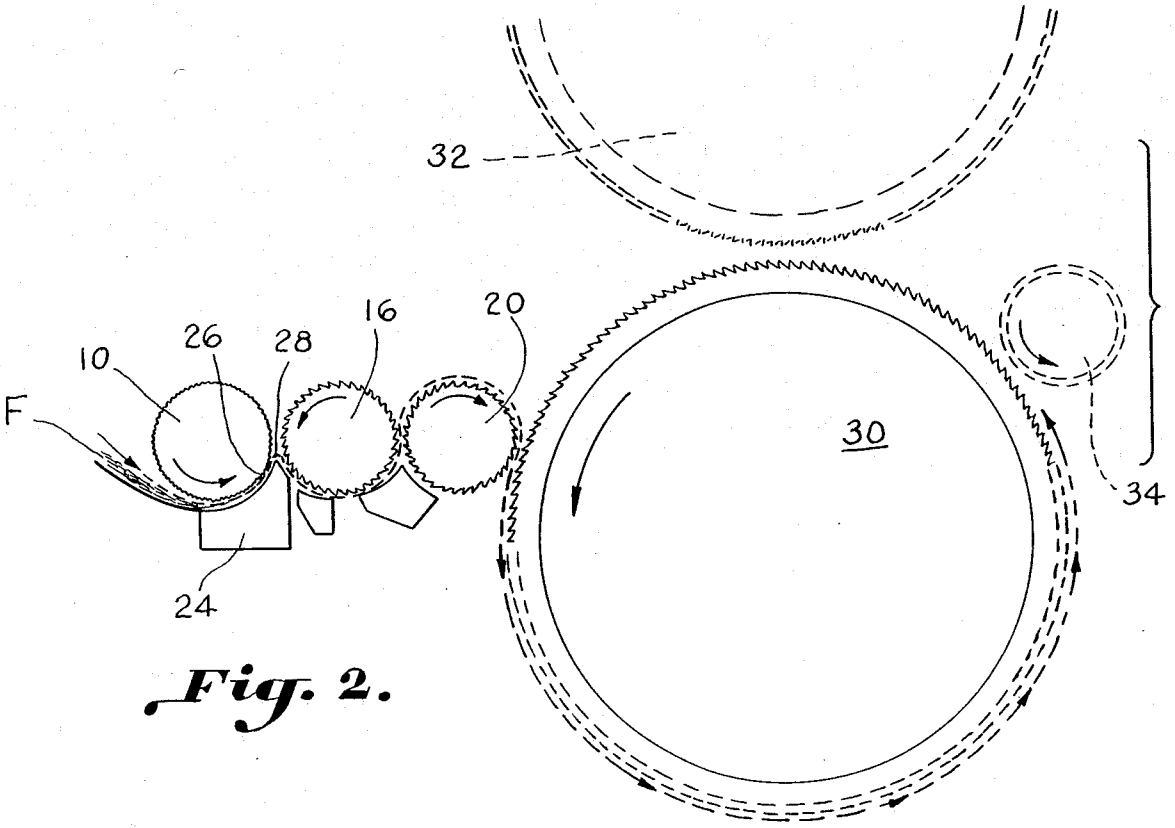
FIG. 2 is a schematic view illustrating a fiber feed system in which the present invention may be incorporated.

Referring now in more detail to the drawings, the fiber infeed arrangement designated generally as A is illustrated which includes a feed roll 10 fixed to a frame of a carding machine which may include a pair of support arms 12. The feed roll is fixed by suitable rotary bearings 14 to arm 12. The feed roll rotates but is otherwise fixed against movement. Adjacent feed roll 10 is a licker-in roll 16 fixed by bearings 18 to arm 12. Next is a redirect roll 20 affixed to arm 12 by suitable bearings 22. As can best be seen in FIG. 2, there is a nipping surface provided by a feed plate 24 fixed beneath feed roll 10 to define a feed nip 26 through which a fiber mass F is fed. Licker-in 16 takes the fibers from the fibrous mass over a nose 28 of feed plate 24 in a carding type action. Fibers are taken from licker-in roll 16 by redirect roll 20 and transferred onto a main carding cylinder 30. It is to be understood, of course, that the invention may be used with any arrangement of fiber feeding employing a feed roll and feed plate. Carding cylinder 30 is conventionally provided with carding means (not shown) by which the fibers on the carding cylinder are subjected to a carding action. The fibers may be transferred to a second carding cylinder 32 from which the fibers may be doffed and formed into a web.

Alternately, the fibers may be taken off by a doffer 34 directly from cylinder 30 in a conventional single cylinder arrangement.

Referring to FIG. 1, it can be seen that a rotational drive means B for rotating feed roll 10 is provided in a form of a variable speed electric motor 36 having a drive shaft coupled to a speed reducer 38. Motor 36 may be adapted to speed reducer 38 by an adapter bracket 36*a*. A shaft 40 of feed roll 10 is directly coupled to the output of speed reducer 38. Electric motor 36 may be any suitable conventional variable speed electric motor which may be controlled by a conventional control 42. Speed reducer 38 may be any suitable speed reducer such as a Graham Circulate brand speed reducer manufactured by the Graham Company of Menomonee Falls, Wisconsin.

As can best be seen in FIG. 1, rotational drive B is freely carried by the shaft of feed roll 10 and is coupled to a reference frame, which may be frame 12, by means of a sensor means designated generally as C. This sensor means C senses a reaction force produced by the forces on drive roll 10 during the feeding of fibrous mass F to the carding machine. This feed may occur, as illustrated, by way of licker-in roll 16 and redirect roll 20. As illustrated, the sensor means C is in the form of a torque sensor which senses the reaction of rotational drive B to the torque of the feed roll produced by the feeding of the fibrous mass.

Figure 3:
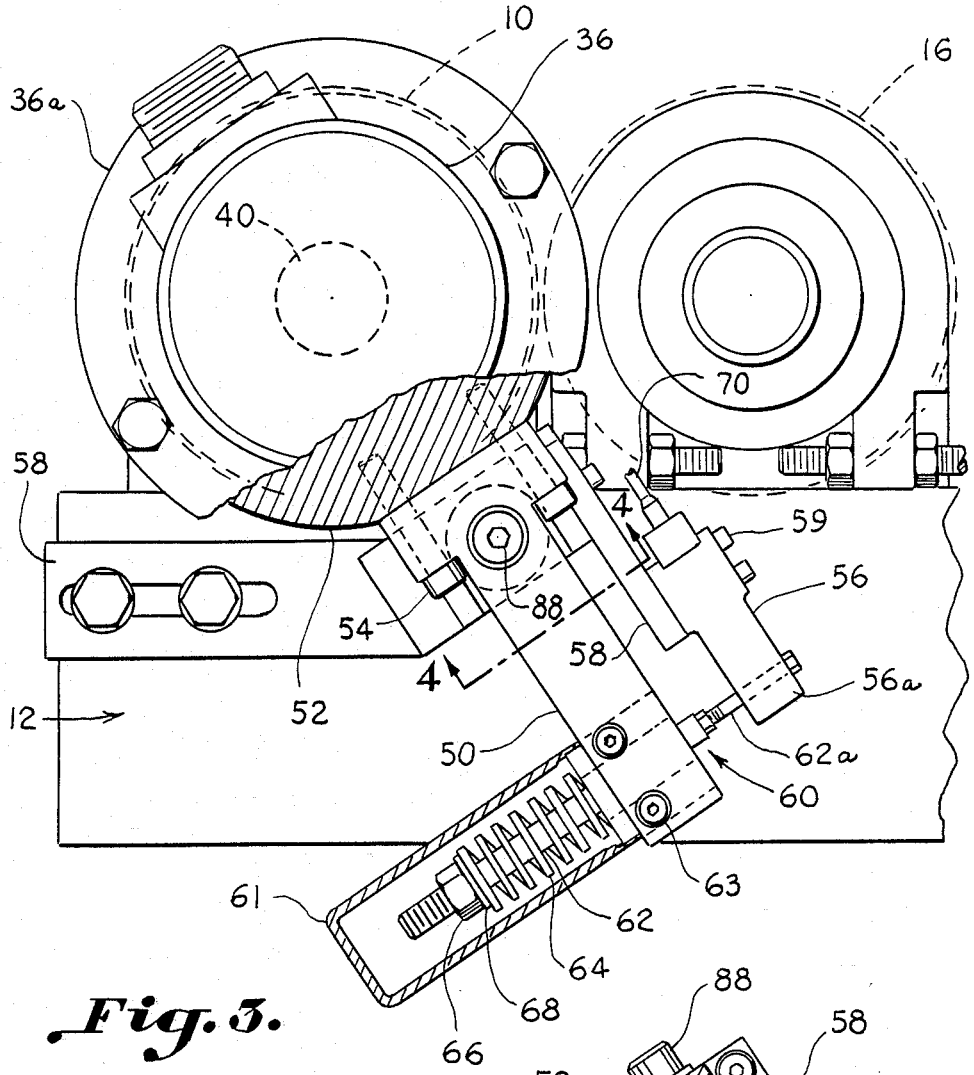
FIG. 3 is an enlarged view of a sensor for a card feed roll constructed in accordance with the present invention.

As can best be seen in FIG. 3, torque sensor means C preferably includes a torque sensing member directly mounted to feed reducer 38 in the form of a radial torque sensing arm 50. Torque sensing arm 50 is attached directly to a machined housing block 52 of speed reducer 38 by means of bolts 54. A torque sensor member in the form of a cantilevered load cell 56 is attached to reference frame 12 by a bracket 58. The load cell is attached to bracket 58 by bolts 59. It is to be understood, of course, that sensor member 56 may be attached to any suitable reference frame. Coupling means for coupling sensing member 50 and sensor member 56 is provided by a mechanical coupling member, designated generally at 60. Coupling member 60 includes a shoulder bolt 62 and a bolt 62*a* slidably received in an arm 56*a* of sensor member 56 threaded into shoulder bolt 62 for adjustment. Shoulder bolt 62 is slidably carried by a block 50*a* affixed to a remote end of torque sensing arm 50 and is enclosed in a housing 61 affixed by bolts 63. A stiff spring 64 provides a biasing means for attaching coupling member 60 to torque sensing arm 50. A nut 66 carrying a washer 68 is threaded onto bolt 62 to attach the spring to the bolt. Normally, reaction forces on speed reducer housing 52 produced by driving feed roll 10 in a counter-clockwise direction will cause the torque arm 50 to be displaced in a clockwise direction. This will cause coupling member 60 to rotate cantilevered arm 56*a* of sensor 56 in a clockwise direction. Sensor member 56 may be any suitable load cell such as a cantilevered beam load cell, model CBU, manufactured by The Revere Corporation of America of Wallingford, Connecticut. Load cell 56 generates an output in the form of a control signal at 70. This control signal will represent a quantitative condition of the fibrous mass F passing through nip 26 of feed roll 10 and feed plate 24. As the thickness of the fiber mass varies, the torque produced on the feed roll will vary. The variation in feed roll torque will create corresponding reaction forces on rotational drive means B. These reactions will be sensed by torque arm 50 due to the rigid attachment to speed reducer housing 52. The reaction forces displace torque arm 50 causing coupling will be noted that coupling member 60 will be displaced along a line of displacement generally perpendicular to radial torque arm 50 tangential to the rotational drive for accuracy and sensitivity. Sensor member 56 will generate a control signal representing the quantity of fibers fed by feed roll 10. The control signal may be used to regulate the speed of feed roll 10 through conventional control 42 so that a prescribed quantity of fibers is fed to carding cylinder 30. Control 42 may be any suitable conventional control or programmable controller which may, along with other operating parameters of the carding machine, produce integrated control of feed roll 10, and produce a carded web or sliver having a uniform weight per unit length.

Figure 4:
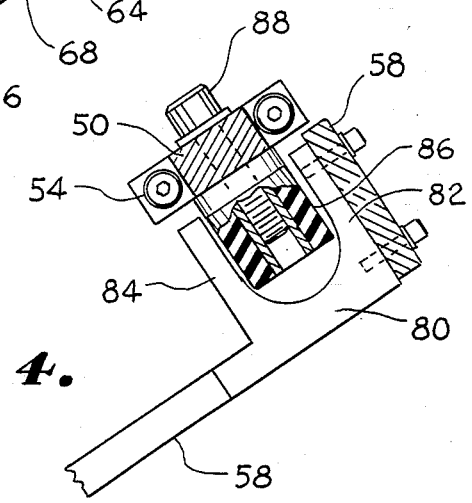
FIG. 4 is a perspective view of the mounting of a sensing member and sensor member constructed in accordance with the present invention.

As can best be seen in FIG. 4, limit means for limiting the relative movement of torque sensing arm 50 and torque sensor 56 is provided. Since torque sensor C couples rotational drive B of the feed roll to the carding machine frame, protection against excessive torques may be needed to prevent mechanical breakage of the sensor C. As can best be seen in FIG. 4, bracket 58 includes a fork 80 having a pair of fork arms 82 and 84.

Arms 82 and 84 provide abutments for a resilient plug 86 carried by torque sensing arm 50. Resilient plug 86 may be any suitable rubber plug which is attached by a bolt 88. Should torque sensing arm 50 be displaced excessively with respect to bracket 58, resilient plug 86, serving as a projection, will engage abutment 82 or 84. Movement between the parts will be limited to prevent mechanical breakage. This excessive torque may be sensed by sensor 56 when utilized to stop operation. It will also be noted that spring 64 serves as a limit means, should excessive torques and displacement of arm 50 be encountered, arm 50 will not rotate cantilevered arm 56*a* excessively, but spring 64 will yield.

Thus, it can be seen that a highly sensitive and accurate sensing of the fibers fed to a carding machine may be had with the sensing apparatus of the present invention by detecting reactional forces produced by the loading during feeding of a card feed roll. Coupling the rotational drive to the carding machine frame by a sensor provides for accurate sensing of the reactional forces produced by feed roll torque as a highly accurate and sensitive indication of the fibers fed by the feed roll. This indication can be used to regulate the rotation of the feed roll and fiber feeding.

While a preferred embodiment of the invention has been described using specific terms, such description is for illustrative purposes only, and it is to be understood that changes and variations may be made without departing from the spirit or scope of the following claims.

What is claimed is:

1. Apparatus for use in a textile machine control system for regulating the amount of textile fibers fed to said machine comprising:

(a) a fixed feed roll rotatably carried by a frame of said machine;

(b) a fixed nipping surface fixably carried adjacent said feed roll to define a fixed nip between said feed roll and nipping surface through which said fibrous mass is fed;

(c) rotational motor drive means for rotating said feed roll;

(d) sensor means for directly and mechanically sensing a reaction of said rotational motor drive means to the torque of the feed roll produced during rotation of said feed roll and feeding said fibrous mass through said nip;

(e) said sensor means generating an electrical a control signal representing a quantitative condition of said fibrous mass for use in regulating said rotational drive means in a manner that a prescribed quantity of said fiber mass is fed to said machine.

2. The apparatus of claim 1 wherein said sensor means includes a torque sensor having a sensing member rigidly carried by said rotational drive means movable in response to said reaction force and feed roll torque, and a sensor member carried by a frame reference.

3. The apparatus of claim 2 wherein said sensing member includes a radial torque arm carried by said rotational drive means.

4. The apparatus of claim 2 including coupling means coupling said sensing member and said sensor means for sensing the movement of said sensing member.

5. The apparatus of claim 4 wherein said coupling means includes a displaceable coupling member mechanically coupling said sensing member and said sensor member.

6. The apparatus of claim 5 wherein said sensing member includes a radial torque arm extending from said rotational drive means housing, said coupling member is displaceable along a line of displacement perpendicular to said radial torque arm in response to said reaction force.

7. The apparatus of claim 6 wherein said displaceable coupling member is connected to said torque arm by a biasing means which yields upon excessive feed roll torques to prevent further displacement of said coupling member and prevent mechanical breakage.

8. The apparatus of claim 5 including limit means for limiting the relative movement between said sensing means and sensor means to prevent meachanicl breakage.

9. The apparatus of claim 8 wherein said limit means comprises an abutment means carried by said reference frame and a projection carried by said torque arm which abuts said abutment to prevent excessive relative movements between said torque arm and abutment and prevent mechanical breakage.

10. The apparatus of claim 9 wherein said limit means includes a biasing means connecting said displaceable coupling member to said torque arm.

11. Apparatus for use in a textile machine control system for regulating the amount of textile fibers fed to said machine comprising:

(a) a feed roll rotatably carried by a frame of said machine;

(b) a nipping surface carried adjacent said feed roll to define a nip between said feed roll and nipping surface through which said fibrous mass is fed;

(c) rotational drive means carried by a shaft of said feed roll in a manner that said drive means may move relative to said frame under reaction to the torque of said feed roll;

(d) a torque sensor means coupled between said rotational drive means and a reference frame of said carding machine for sensing feed roll torque produced on said feed roll in response to feeding of said fiber mass through said nip; and (e) said torque sensor means generating a control signal representing a quantitative condition of said fiber mass fed by said feed roll to said machine for use in regulating the rotational speed of said feed roll to feed a prescribed quantity of fiber mass to said machine.

12. The apparatus of claim 11 wherein said torque sensor means includes a sensing member carried by said rotational drive means, a torque sensor carried by said reference frame, and mechanical coupling means coupling said sensing member and sensor member in a manner that said rotational drive means and reference frame are mechanically coupled.

13. The apparatus of claim 12 including limit means for limiting the relative movement of said sensing member and sensor member to prevent mechanical breakage due to the coupling.

14. The apparatus of claim 13 wherein said coupling means comprises a displaceable coupling member which moves along a line of displacement generally tangent with said rotational drive means.

15. The apparatus of claim 12 including biasing means disposed between said sensing member and said displaceable coupling member.

16. Apparatus for use in a textile machine control system for regulating the amount of textile fibers fed to said machine comprising:

(a) a driven feed roll rotatably carried by a frame of said machine;

(b) a feed plate defining a nip with said feed roll through said fibrous mass is fed to said machine;

(c) rotational drive means carried solely on a free end of a shaft of said feed roll for directly rotating said feed roll; and (d) sensor means for sensing a reactional force to the torque exerted on said feed roll while delivering said fibrous mass through said nip and for generating a signal representing a quantitative condition of said fibrous mass for use regulating the rotational speed of the feed roll to feed a prescribed quantity of said fibrous mass to said machine.

* * * * *